US007059558B2

(12) United States Patent
Kayanuma et al.

(10) Patent No.: US 7,059,558 B2
(45) Date of Patent: Jun. 13, 2006

(54) RECORDING MATERIAL CONTAINING DEVICE FOR RECORDING MATERIAL ROLL

(75) Inventors: Yasunobu Kayanuma, Saitama (JP); Akimasa Kaya, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 128 days.

(21) Appl. No.: 10/370,609

(22) Filed: Feb. 24, 2003

(65) Prior Publication Data

US 2003/0160121 A1 Aug. 28, 2003

(30) Foreign Application Priority Data

Feb. 22, 2002 (JP) ..... 2002-047070

(51) Int. Cl.
*B65H 16/06* (2006.01)

(52) U.S. Cl. ..... 242/562; 242/348.3; 242/564.5

(58) Field of Classification Search ..... 242/388, 242/340, 384.3, 384.4, 348, 562, 562.1, 564.5, 242/596, 596.7, 598.3, 338, 348.3, 348.4; 400/613, 613.1, 614, 634

See application file for complete search history.

(56) References Cited

U.S. PATENT DOCUMENTS

| | | | | |
|---|---|---|---|---|
| 1,796,912 | A * | 3/1931 | Wood | 242/564.5 |
| 2,649,256 | A * | 8/1953 | Skrebba | 242/562.1 |
| 3,670,989 | A * | 6/1972 | Andrews | 242/332.6 |
| 3,779,473 | A * | 12/1973 | Edrinn | 242/564.5 |
| 3,834,204 | A * | 9/1974 | Ihle | 72/183 |
| 5,249,754 | A * | 10/1993 | Liermann et al. | 242/562 |
| 5,947,408 | A * | 9/1999 | Miyake | 242/562 |
| 2001/0052559 | A1 | 12/2001 | Inana et al. | |

FOREIGN PATENT DOCUMENTS

| | | |
|---|---|---|
| JP | 9-165126 | 6/1997 |
| JP | 10-291350 | 11/1998 |

* cited by examiner

*Primary Examiner*—Kathy Matecki
*Assistant Examiner*—Scott Haugland
(74) *Attorney, Agent, or Firm*—Sughrue Mion, PLLC

(57) ABSTRACT

A recording material roll is constituted by winding thermosensitive recording material of paper. A recording material magazine for the recording material roll includes a containing chamber, which contains the recording material roll. A supply roller is secured to the containing chamber in a rotatable manner, and advances the recording material from the recording material roll to an outside of the containing chamber. A pressing roller is disposed away from the supply roller in a winding direction of the recording material roll, and presses an outermost turn of the recording material roll.

6 Claims, 7 Drawing Sheets

RECORDING MATERIAL CONTAINING DEVICE FOR RECORDING MATERIAL ROLL

BACKGROUND OF THE INVENTION

1. Field of the Invention

The present invention relates to a recording material containing device for a recording material roll. More particularly, the present invention relates to a recording material containing device for a recording material roll, in which a leader of recording material can be positioned easily and exactly.

2. Description Related to the Prior Art

JP-A 10-291350 and U.S. Pub. No. 2001/0052559 (corresponding to JP-A 2001-192152) disclose a recording material magazine for use with a printer, such as a thermal printer. The recording material magazine includes a magazine casing and a lid, and contains a recording material roll formed by winding recording material of paper. A supply roller is incorporated in the magazine casing. The supply roller is driven by a mechanism included in the printer, and unwinds and advances the recording material from the recording material roll into the printer. For the purpose of ensuring the advance of the recording material, the recording material magazine is provided with a pressing mechanism, a separator plate, a guide member and the like. The pressing mechanism presses a leader or outermost turn of the recording material toward the supply roller. The separator plate is disposed away from a contact position of the recording material roll for contact with the supply roller with reference to an unwinding direction, and abuts and separates an end of the leader from the recording material roll. The guide member guides the leader toward an exit opening of the recording material magazine.

However, the recording material magazine of the prior art requires positioning of the end of the leader of the recording material into a space under the supply roller in loading of the recording material magazine with the recording material roll. The end of the leader must be set in a very small range which lies between the contact position of the supply roller and the separator plate. Therefore, operation of setting the recording material roll requires much time, and involves considerable difficulty. Furthermore, the recording material roll must be rotated manually for the purpose of positioning the end of the leader of the recording material into a small range between the separating position and the supply roller. There occurs pollution of the recording material roll with dirt, fingerprints or the like in the course of handling.

SUMMARY OF THE INVENTION

In view of the foregoing problems, an object of the present invention is to provide a recording material containing device for a recording material roll, in which a leader of recording material can be positioned easily and exactly.

In order to achieve the above and other objects and advantages of this invention, a recording material containing device for a recording material roll constituted by winding of recording material is provided. A containing chamber contains the recording material roll. A supply roller is secured to the containing chamber in a rotatable manner, for rotating the recording material roll by contacting an outermost turn of the recording material roll, to advance the recording material to an outside of the containing chamber upon separation from the recording material roll. A pressing mechanism includes a pressing roller disposed away from the supply roller in a winding or unwinding direction of the recording material roll, the pressing roller being caused in the pressing mechanism to press the outermost turn of the recording material roll.

Furthermore, an actuating mechanism is associated with the pressing mechanism, for setting the pressing roller in a releasing position before loading of the recording material roll, to form a space range in the containing chamber over a maximum diameter of the recording material roll, so as to smoothen the loading, and for setting the pressing roller in a pressing position after the loading, to press the outermost turn of the recording material roll.

Furthermore, a pair of bearing mechanisms are provided, each of which has a U-shaped gap for supporting a shaft protruding from ends of the recording material roll in a removable and rotatable manner, the shaft being included in a roll holder fitted on the recording material roll.

The pressing roller is positioned upstream from the supply roller with reference to a direction perpendicular to a roll inserting direction in which the shaft is inserted into the U-shaped gap.

The pressing mechanism further includes a pair of supply roller support levers for supporting the supply roller in a rotatable manner therebetween, each of the supply roller support levers including first and second ends, the first end constituting a center about which the supply roller support levers are rotatable, the second end supporting the supply roller. A pair of pressing roller support arms are secured to respectively the supply roller support levers in a rotatable manner, each of the support arms including third and fourth ends, the third end supporting the pressing roller in a rotatable manner between the support arms. An auxiliary pressing roller is secured to the fourth end in a rotatable manner between the support arms, positioned downstream from the supply roller with reference to the roll inserting direction, for contacting the outermost turn of the recording material roll. A spring biases the supply roller support levers rotationally in a first direction, to set the pressing roller in the pressing position, and to set the supply roller in contact with the outermost turn of the recording material roll.

The supply roller contacts the recording material roll in a vicinity of a portion of which a height of the outermost turn is maximum as viewed in the roll inserting direction.

The actuating mechanism includes an operation lever shiftable between first and second shifted positions. A driving lever moves between first and second positions in response to a shift of the operation lever, the first position being away from at least a first support lever included in the supply roller support levers, the second position being close to the first support lever, the spring being connected between the driving lever and the first support lever, wherein the driving lever, when in the first position, charges the spring in a manner for rotating the first support lever in the first direction, and when in the second position, releases the spring from being charged, and allows the first lever to rotate in reverse to the first direction, so as to set the pressing roller in the releasing position, and to set the supply roller away from the outermost turn of the recording material roll.

Furthermore, a separator support lever is disposed coaxially with the supply roller support levers about the first end, for rotating together with the supply roller support levers. A separating plate is secured fixedly to a free end of the separator support lever, for contacting the outermost turn of the recording material roll in a position downstream from the auxiliary pressing roller with reference to the roll inserting direction, so as to separate a leader of the recording material from the recording material roll.

Furthermore, a plate positioning roller is secured to the separator support lever and near to the free end in a rotatable manner, for contacting the outermost turn of the recording material roll.

The containing chamber is defined inside a magazine including a magazine casing and a lid. The magazine casing has an upper opening, and an exit opening for passing the recording material separated by the separating plate. The lid is secured to the magazine casing in a manner to close the upper opening in an openable manner.

According to a preferred embodiment, the containing chamber has first and second lateral panels, disposed to extend along an axis of the recording material roll, opposed to each other, the support arm being disposed close to the first lateral panel. When the first pressing roller is in the releasing position, the supply roller and the first pressing roller are set at respectively distances L1 and L2 from the second lateral panel, and the distances L1 and L2 are larger than the diameter of the recording material roll.

Furthermore, an exit opening is formed with the containing chamber, positioned close to the first lateral panel, disposed lower than the supply roller and the first pressing roller, for exiting the recording material to the outside from the recording material roll.

A driving mechanism having the driving lever further causes the supply roller support levers to shift the supply roller, the first pressing roller and the auxiliary pressing roller toward a roll center according to a decrease in the diameter of the recording material roll being used.

Furthermore, a bias mechanism biases the support arm to a ready position before the loading of the recording material roll, to protrude the auxiliary pressing roller over a position of the outermost turn of the recording material roll toward the roll center. The auxiliary pressing roller is pressed by the recording material roll being loaded, and shifts the support arm rotationally about the arm middle portion, and thereafter the driving mechanism rotates the supply roller support levers.

Furthermore, an auxiliary bias spring biases the driving lever toward the first position, whereby the external operation lever is biased toward the first shifted position.

The auxiliary bias spring biases the driving lever toward the first position when the driving lever is between the first position and one middle position, and biases the driving lever toward the second position when the driving lever is between the second position and the middle position, so as to facilitate an external operation of shifting of the external operation lever toward each of the first and second shifted positions when the external operation lever moves past one intermediate position.

The driving lever is rotatable about a first rotational shaft. The auxiliary bias spring is a second tension coil spring, having first and second spring end portions between which the first rotational shaft is located, the first spring end portion being secured to the containing chamber, the second spring end portion being secured to an end portion of the driving lever. The second tension coil spring, when the driving lever is in each of the first and second positions, has a small length before application of tensile load thereto, and when the driving lever is in the middle position, receives application of a maximal tensile load, to bias the driving lever toward the first or second position.

Furthermore, a slidable shifting plate transmits shifting of the external operation lever to the driving lever.

Furthermore, a click retaining mechanism resiliently retains the external operation lever set in each of the first and second shifted positions, the click retaining mechanism being released upon applying force to the external operation lever.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

A recording material containing device of the invention is herein described by way of a recording material magazine. The recording material magazine is set in a magazine holder chamber in a printer. Principal purposes of the recording material magazine are to supply the recording material into the printer upon receiving transmission of rotation of a motor in the printer, and to protect the recording material in a light-tight and air-tight manner.

Figure 1:
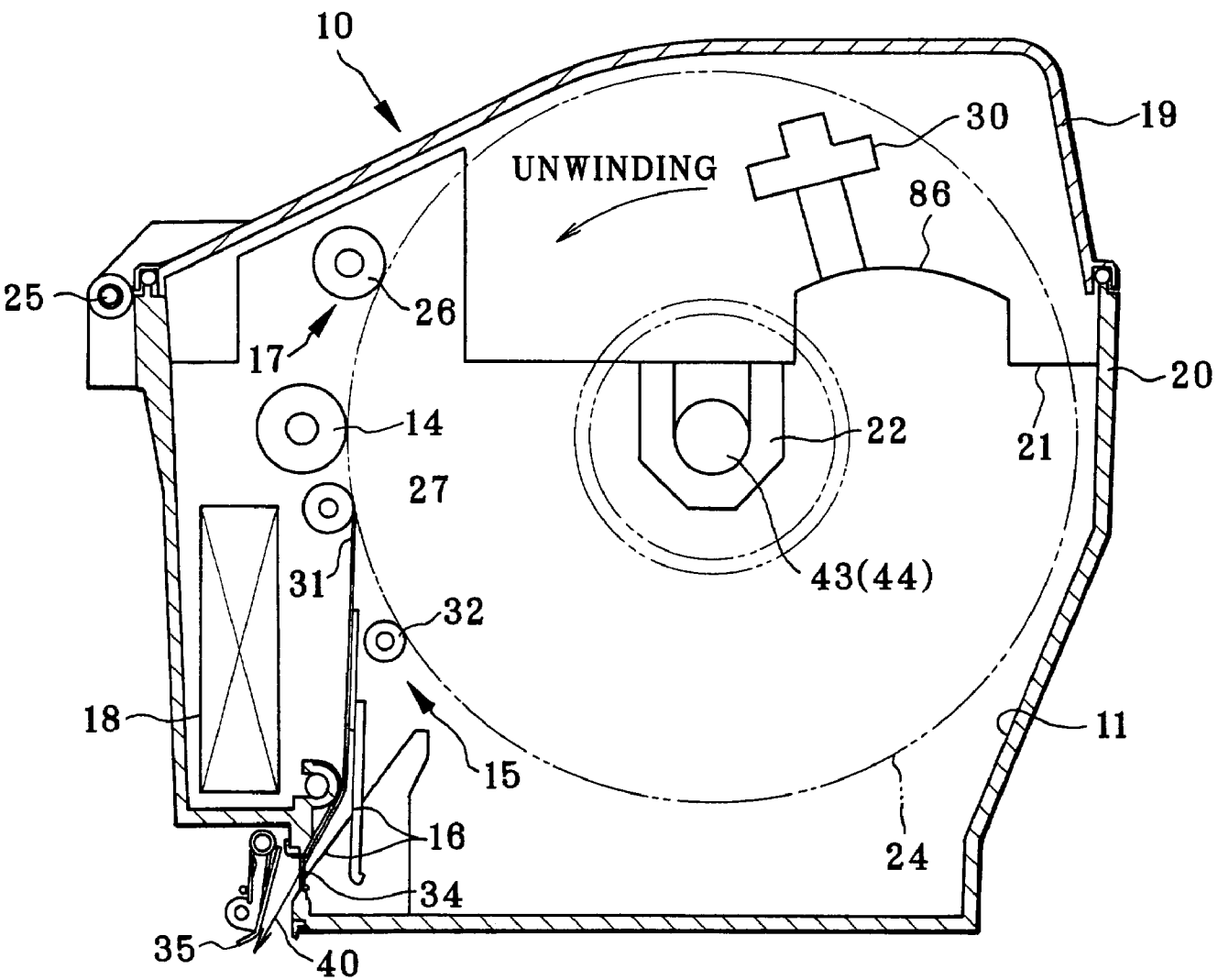
FIG. 1 is a cross section illustrating a recording material magazine of the present invention.

In FIG. 1, a recording material magazine 10 as recording material containing device is constituted by a containing chamber 11, a recording material roll unit 13, a supply roller 14, an end separator 15, an end guide 16, a pressing mechanism 17 and a moving unit 18. The recording material magazine 10 includes a lid 19 and a magazine casing 20. Two guide end plates 21 are secured to the magazine casing 20, and disposed at a predetermined distance. U-shaped bearing gaps 22 are secured to inner surfaces of the guide end plates 21. The bearing gaps 22 are so oriented that their open ends are directed upwards. A pair of holder shafts 43 and 44 extend from ends of the recording material roll unit 13, and are inserted in the bearing gaps 22. Thus, the recording material roll unit 13 is held between the guide end plates 21. A recording material roll 24 is included in the recording material roll unit 13.

A lateral panel hinge 25 connects the lid 19 to the magazine casing 20 rotatably, and closes the containing chamber 11 in an openable manner. A packing is attached to surfaces of the lid 19 and the magazine casing 20 combined with each other, and keeps the inside air-tight.

The supply roller 14 rotates the recording material roll 24 in the unwinding direction, and is movable between effective and ineffective positions, and when in the effective position, presses the peripheral surface of the recording material roll 24, and when in the ineffective position, is away from the recording material roll 24.

The pressing mechanism 17 is constituted by a main pressing roller 26 and an auxiliary pressing roller 27. The main and auxiliary pressing rollers 26 and 27 are so positioned as to contact portions of the peripheral surface of the recording material roll 24 which are respectively higher and lower than the supply roller 14. The main and auxiliary pressing rollers 26 and 27 are movable between pressing and releasing positions, and when in the pressing position, press the recording material roll 24, and when in the releasing position, are away from the recording material roll 24.

A lever grip 30 in an external operable lever is located in the magazine, and when shifted by manual operation, causes the moving unit 18 to shift the supply roller 14, and also shift the main and auxiliary pressing rollers 26 and 27. Note that it is possible to shift the main and auxiliary pressing rollers 26 and 27 in response to shifting of the supply roller 14. When the lid 19 is opened, the lever grip 30 is uncovered, and shifted between first and second shifted positions, and when in the first shifted position, sets the supply roller 14, the main and auxiliary pressing rollers 26 and 27 away from the recording material roll 24, and when in the second shifted position, presses the supply roller 14, the main and auxiliary pressing rollers 26 and 27 against the recording material roll 24. Before the removal of the recording material roll 24, the lever grip 30 is shifted to the first shifted position to set the supply roller 14, the main and auxiliary pressing rollers 26 and 27 in the ineffective position and releasing position so that a user can unload the recording material roll 24.

The end separator 15 is constituted by a separating plate 31 and a plate positioning roller 32. The separating plate 31 separates the leader of the recording material roll 24, is movable between near and far positions, and when in the near position, is set at a predetermined short interval from the outermost turn of the recording material roll 24, and when in the far position, is much farther from the recording material roll 24.

The plate positioning roller 32 is disposed away from a position of contact of the separating plate 31 with the recording material roll 24 in the unwinding direction, and is movable with the separating plate 31. When recording material 40 of paper in the recording material roll 24 comes in contact with the plate positioning roller 32, the plate positioning roller 32 becomes disposed to position an end of the separating plate 31 in the near position. The end separator 15 also moves in response to operation of the lever grip 30. Note that it is possible to shift the end separator 15 or the main and auxiliary pressing rollers 26 and 27 in response to shifting of the supply roller 14.

An exit opening 34 is formed in a lower portion of the magazine casing 20 for passage of the recording material 40. A shutter lid 35 is associated with the exit opening 34. The shutter lid 35 is shiftable between shut and open positions, and when in the shut position, shuts the exit opening 34, and when in the open position, opens the exit opening 34. A spring biases the exit opening 34 toward the shut position. At the time of feeding the recording material, a driving mechanism in the printer presses and shifts the shutter lid 35 to the open position.

The leader of the recording material roll 24 being separated by the recording material roll unit 13, the end guide 16 guides the leader toward the exit opening 34.

Figure 2:
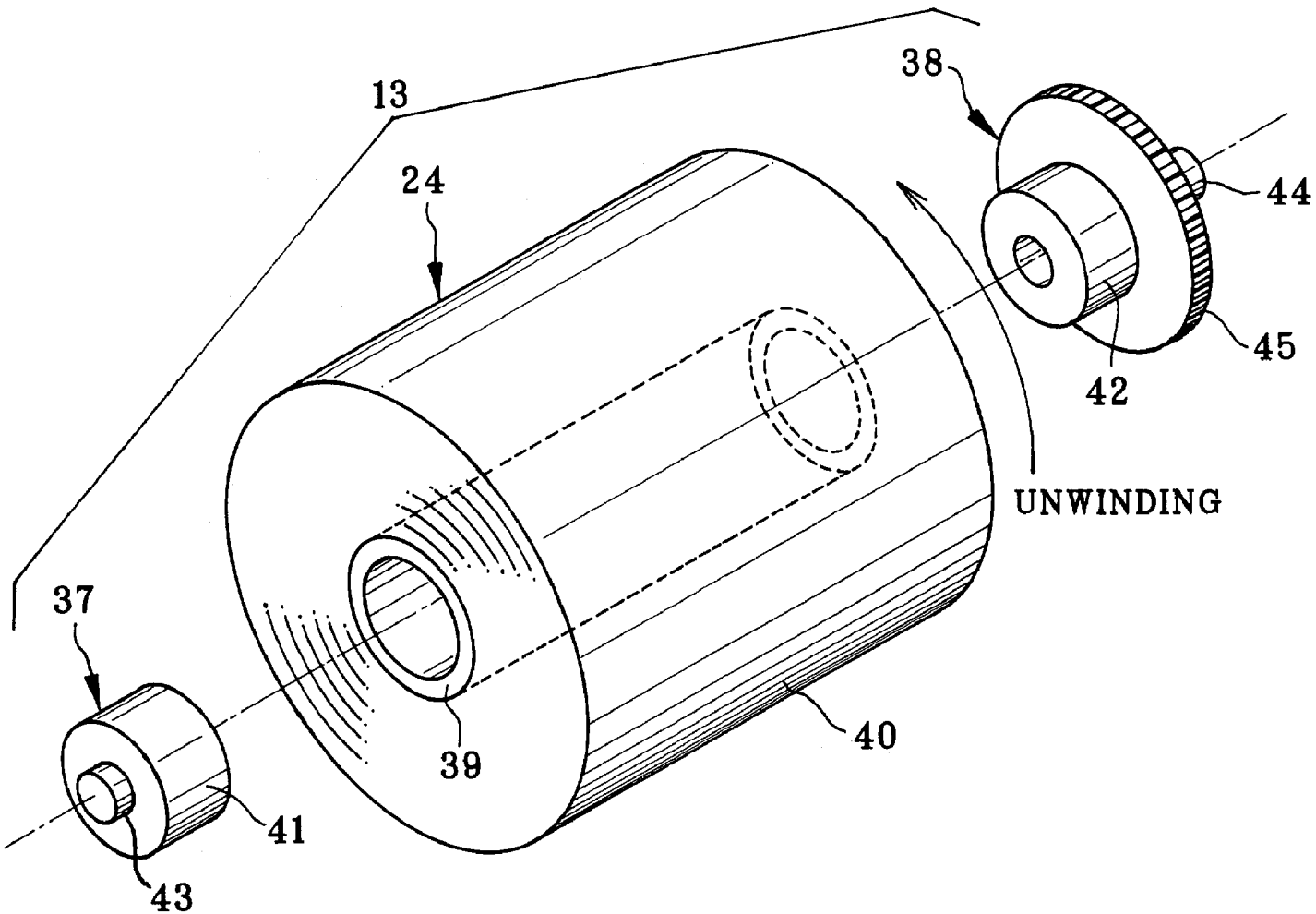
FIG. 2 is a perspective illustrating a recording material roll and roll holders.

In FIG. 2, the recording material roll unit 13 is constituted by the recording material roll 24 and a pair of roll holders 37 and 38. A tube-shaped core 39 as central axis is located at the center of the recording material roll 24, and is adapted to wind the recording material 40.

The roll holders 37 and 38 are secured to ends of the core 39 in a removable manner. Drums 41 and 42 constitute respectively the roll holders 37 and 38. Also, the holder shaft 43 is inserted through the drum 41, and protrudes partially. The holder shaft 44 is inserted through the drum 42, and protrudes partially. The drums 41 and 42 are fitted in the core 39 to support the same.

The holder shafts 43 and 44 pivotally support the drums 41 and 42, and are supported by the bearing gaps 22 at their portions outside the drums 41 and 42. At the time of winding, a gear 45 at the holder shaft 44 of the roll holder 38 is rotated by a mechanism in the printer, to cause the recording material roll 24 to rotate in the winding direction. A one-way clutch is incorporated in each of the drums 41 and 42. The one-way clutch discontinues transmission between the holder shaft 43 and the drum 41 and between the holder shaft 44 and the drum 42 during rotation of the recording material roll 24 in the unwinding direction, and transmits rotation of the holder shafts 43 and 44 to the drums 41 and 42 during rotation of the recording material roll 24 in the winding direction. At the time of unwinding, the drums 41 and 42 are set free from the holder shafts 43 and 44, to enable the recording material roll 24 to be rotated by the supply roller 14 in the unwinding direction.

Figure 3:
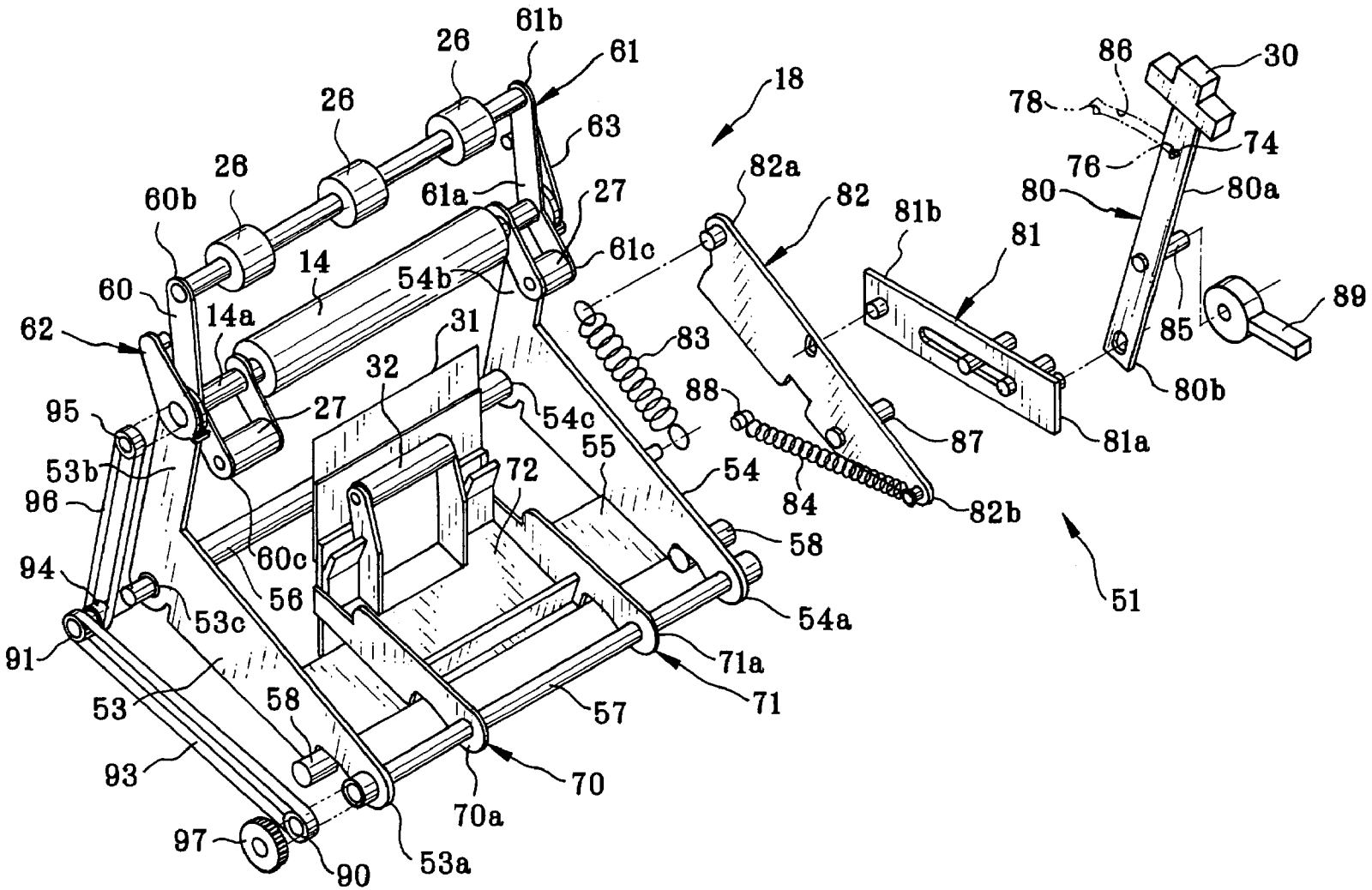
FIG. 3 is an exploded perspective illustrating a supply roller, first and second pressing rollers, together with a moving unit for those.
Figure 4:
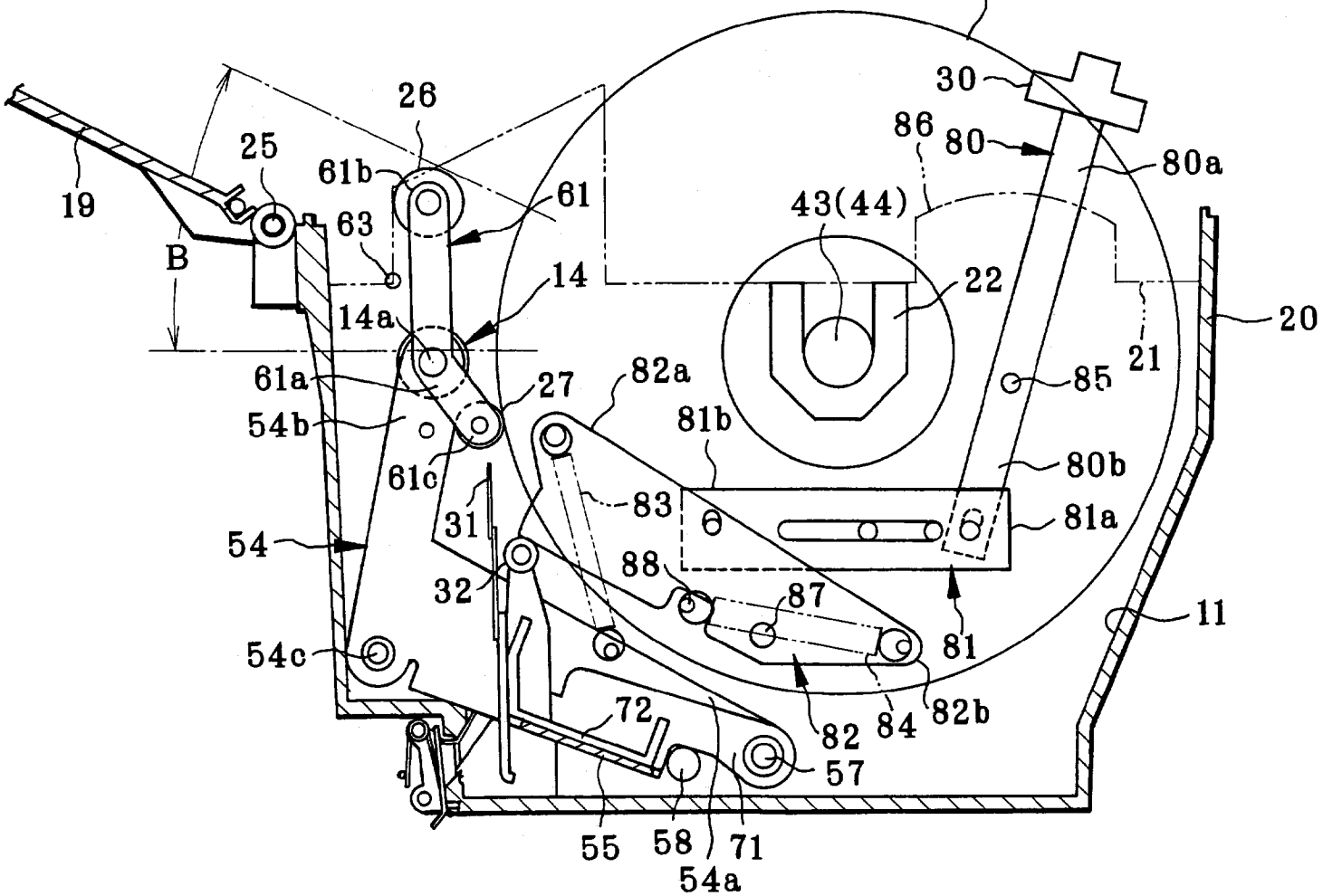
FIG. 4 is a cross section illustrating a state of loading the recording material magazine with the recording material roll but before shifting the pressing roller.

In FIGS. 3 and 4, the moving unit 18 is provided with an actuating mechanism 51 that comprises a driving mechanism. The moving unit 18 operates for shifting together the supply roller 14, the main and auxiliary pressing rollers 26 and 27, the separating plate 31, the plate positioning roller 32 and the like, and is constituted mainly by a supply roller support lever 54, a subsidiary supply roller support lever 53, support arms 60 and 61, and separator support levers 70 and 71.

To support the supply roller 14, the supply roller support levers 53 and 54 are used, which are provided with an intermediate plate 55 and an intermediate rod 56 for connection. The supply roller support lever 54 constitutes a moving unit. The supply roller support levers 53 and 54 have a similar L-shape. Support end portions 53*a* and 54*a* of the supply roller support levers 53 and 54 are supported in a rotatable manner by a pivotal rod 57 between the guide end plates 21. So the supply roller support levers 53 and 54 are rotatable between upper and lower positions, and when in the upper position, sets the supply roller 14 in the effective position, and when in the lower position, sets the supply roller 14 in the ineffective position. A rotational direction toward the upper position is a direction to shift the supply roller 14 toward the center of the recording material roll 24. There are stoppers 58 close to the supply roller support levers 53 and 54, which are in the lower position when in contact with the stoppers 58. Pivotal end portions 53*b* and 54*b* of the supply roller support levers 53 and 54 support a roller shaft 14*a* of the supply roller 14 in a rotatable manner. Connection portions 53*c* and 54*c* of the supply roller support levers 53 and 54 are connected together by the intermediate rod 56. The intermediate plate 55 is secured between portions extending from the support end portion 53*a* to the connection portion 53*c* and from the support end portion 54*a* to the connection portion 54*c*.

To support the main and auxiliary pressing rollers 26 and 27, the support arms 60 and 61 in the V-shape are used. Regulation guides 62 and 63 regulate rotation of the support arms 60 and 61. The support arms 60 and 61 are so disposed that the inside of their V-shaped bend is opposed to the recording material roll 24. Arm middle portions 60*a* and 61*a* are included in the support arms 60 and 61, and supported on the roller shaft 14*a* of the supply roller 14 in a rotatable manner. When the supply roller support levers 53 and 54 are in the upper position, the main and auxiliary pressing rollers 26 and 27 are shifted to the pressing position to contact the recording material roll 24.

Upper end portions 60*b* and 61*b* of the support arms 60 and 61 support the pressing roller 26 in a rotatable manner. Lower end portions 60*c* and 61*c* support the auxiliary pressing roller 27 in a rotatable manner. The main and auxiliary pressing rollers 26 and 27 are pivotally moved about the roller shaft 14*a* of the supply roller 14 together at the predetermined interval. The regulation guides 62 and 63 limit a range of rotation to prevent the main and auxiliary pressing rollers 26 and 27 from rotating in reverse. Note that the pressing roller 26 includes three roller elements, which are disposed away from one another in the axial direction. The auxiliary pressing roller 27 includes two roller elements, which are disposed away from one another in the axial direction, and contact lateral edge portions of the recording material roll 24 in the width direction to separate the center of the outermost turn of the recording material roll 24 at the separating plate 31. The separating plate 31 has a size corresponding to a middle portion of the recording material roll 24 defined between the portions contacted by the auxiliary pressing roller 27 in the width direction of the recording material roll 24, so as to separate the middle portion.

There are torsion coil springs 66 or other bias elements, associated with respectively the support arms 60 and 61, for biasing those in the counterclockwise direction. This causes the auxiliary pressing roller 27 to protrude over a position of the outermost turn of the recording material roll 24 when the support arms 60 and 61 are in a free state.

To separate the leader of the recording material, the separator support levers 70 and 71 are used, and connected together by an intermediate plate 72. The separator support levers 70 and 71 are disposed between the supply roller support levers 53 and 54, and positioned at a predetermined interval. Ends 70*a* and 71*a* of the separator support levers 70 and 71 receive insertion of the pivotal rod 57 in a rotatable manner. The intermediate plate 72 is flat between the separator support levers 70 and 71, and has the upside where the separating plate 31 and the plate positioning roller 32 are disposed. The intermediate plate 55 is disposed to contact the underside of the intermediate plate 72. The separator support levers 70 and 71 move together with the intermediate plate 55.

The actuating mechanism 51 is constituted by an external operation lever 80, a slidable auxiliary shifting plate 81, a rotatable driving lever 82, a first tension coil spring 83 and a second tension coil spring 84. A pivot 85 projects from one of the guide end plates 21, and supports the external operation lever 80 in a rotatable manner. The external operation lever 80 includes a first lever end 80*a* at which the lever grip 30 is connected with the external operation lever 80. A second lever end 80*b* is connected with a first plate end 81*a* of the auxiliary shifting plate 81. There is a slot 86 through which the external operation lever 80 comes. A retention pin 74 projects from the external operation lever 80 as a click retaining mechanism. Two retention notches 76 and 78 are formed in an edge of the slot 86. In shifting the lever grip 30, the retention pin 74 on the external operation lever 80 is engaged with a selected one of the retention notches 76 and 78, so the lever grip 30 is retained in a clicked state in the first and second shifted positions with looseness sufficient for easy disengagement. The auxiliary shifting plate 81 is slidable horizontally. A second plate end 81*b* of the auxiliary shifting plate 81 is connected with the vicinity of a center the driving lever 82. A rotational shaft 87 projects from the guide end plate 21, and supports the driving lever 82 in a rotatable manner. The driving lever 82, when the lever grip 30 is in the first shifted position, is rotationally set in the first rotational position that is nearly horizontal as depicted, and when in the lever grip 30 is in the second shifted position, is set in the second rotational position with a sharper inclination and in the clockwise direction. Note that the driving lever 82 operates in the driving mechanism in the moving unit. The first tension coil spring 83 operates as elastic member in the driving mechanism. The second tension coil spring 84 operates as second bias element.

The first tension coil spring 83 is connected between a plate end 82*a* of the driving lever 82 and the supply roller support lever 54. When the driving lever 82 is in the second position, the first tension coil spring 83 applies force to the supply roller support levers 53 and 54 toward the upper position with tension. When the driving lever 82 is in the first position, the first tension coil spring 83 does not exert force of biasing the supply roller support levers 53 and 54. At this time, the first tension coil spring 83 has its original length without being stretched because of lack of tensile load.

A spring end retainer 82*b* is formed at an end of the driving lever 82. A spring end pin 88 projects from one of the guide end plates 21. The second tension coil spring 84 is connected between the spring end retainer 82*b* and the spring end pin 88. When the driving lever 82 is in the first position, the second tension coil spring 84 applies tensile load to the external operation lever 80 in a direction to shift the lever grip 30 in the first shifted position. When the driving lever 82 is in the second position, no tensile load is applied by the second tension coil spring 84.

A safety lever 89 is attached to the external operation lever 80, and extends toward the outside of the magazine casing. The safety lever 89 is rotatable together with the external operation lever 80. If a user has forgotten to shift the lever grip 30 to the second shifted position, a projection of a printer pushes the safety lever 89 to rotate the external operation lever 80 automatically so as to set the lever grip 30 in the second shifted position.

To drive the supply roller 14, a belt type of driving mechanism is used. The driving mechanism includes a first belt 93 and a second belt 96. Pulleys 90 and 91 are attached to respectively an end of the pivotal rod 57 and an end of the intermediate rod 56. The first belt 93 is connected with the pulleys 90 and 91. Pulleys 94 and 95 are attached to respectively the end of the intermediate rod 56 and an end of the roller shaft 14*a* of the supply roller 14. The second belt 96 is connected with the pulleys 94 and 95. A shaft of the pulley 90 at the pivotal rod 57 appears outside the magazine casing 20. An input gear 97 is attached to the shaft of the pulley 90. The input gear 97 is driven by an element in the printer. Rotation of the input gear 97 is transmitted by the first and second belts 93 and 96 to the roller shaft 14*a* of the supply roller 14. In the printer, a driving system for the supply roller 14 includes a one-way clutch. At the time of unwinding, the clutch transmits rotation to the supply roller 14. At the time of winding, the clutch makes the supply roller 14 free by discontinuing the transmission.

The operation of the above construction is described now. To assemble parts of the recording material roll unit 13, the drums 41 and 42 of the roll holders 37 and 38 are inserted into respectively the end openings of the core 39. After the insertion, the holder shafts 43 and 44 of the roll holders 37 and 38 are manually set into the recording material magazine 10.

Figure 5:
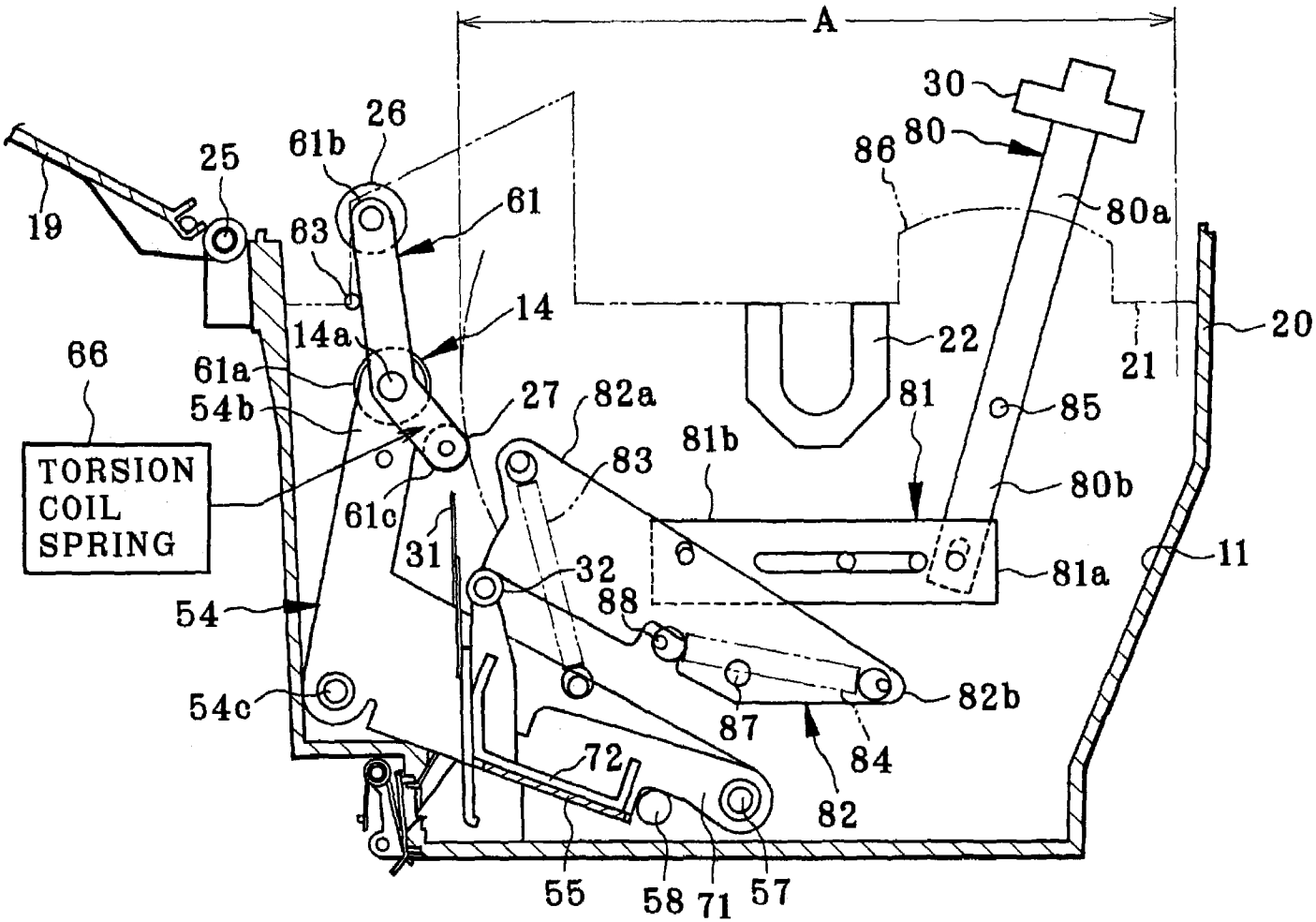
FIG. 5 is a cross section illustrating a state before loading the recording material magazine with the recording material roll.

The lid 19 of the recording material magazine 10 is opened, to insert the recording material roll unit 13 into the magazine casing 20. To this insertion, the holder shafts 43 and 44 of the recording material roll unit 13 are set into the bearing gaps 22. As illustrated in FIG. 5, the lever grip 30 is retained in the first shifted position in a clicked state with the pin and notch. The driving lever 82 is now in the first position. The click mechanism with the pin and notch prevents the external operation lever 80 from rotating toward the second shifted position of the lever grip 30 in a state biased by the second tension coil spring 84.

As the driving lever 82 is in the first position, there is no tensile load of the first tension coil spring 83. The stoppers 58 cause the supply roller support levers 53 and 54 to remain in the lower position. The supply roller 14 is in the ineffective position. The torsion coil springs 66 in combination with the regulation guides 62 and 63 regulate rotation of the support arms 60 and 61 to position the auxiliary pressing roller 27 across the outermost point of the recording material roll 24 which will be set. Therefore, the pressing roller 26 is located outside the range A where the recording material roll 24 moves for setting the recording material roll unit 13. It is possible to keep the range A for the purpose of safely passing the recording material roll 24 for loading by suitably positioning the pressing roller 26.

When the recording material roll unit 13 is set, the auxiliary pressing roller 27 contacts the peripheral surface of the recording material roll 24, which presses and shifts the auxiliary pressing roller 27 to a small amount. In FIG. 4, the support arm 61 rotates in the clockwise direction about the roller shaft 14*a* of the supply roller 14. The pressing roller 26 comes nearer to the periphery of the recording material roll 24. The main and auxiliary pressing rollers 26 and 27 have not yet applied force to press the recording material roll 24. However, the auxiliary pressing roller 27 is an element operating in an auxiliary manner to shift the pressing roller 26 in a halfway step which is short of the pressing position.

To set the recording material roll unit 13, the leader of the recording material 40 or outermost turn of the recording material roll 24 is carefully checked and positioned. The leader of the recording material roll 24, as illustrated in FIG. 4, is set in the range B in the periphery of the recording material roll 24 and between the positions of the pressing roller 26 and the supply roller 14. Note that the auxiliary pressing roller 27 in the embodiment makes it possible to advance the leader of the recording material roll 24 reliably even if the leader is set between the main and auxiliary pressing rollers 26 and 27 beside the supply roller 14. It follows that the disposition of the pressing roller 26 with the supply roller 14 makes it possible to position the leader of the recording material roll 24 even with considerably low precision. Operation of setting the recording material roll 24 can be simple.

After this, the lever grip 30 is shifted to the second shifted position. Upon application of manual force to the lever grip 30, the lever grip 30 is released from the retention in the clicked state. The external operation lever 80 rotates about the pivot 85 in the counterclockwise direction, to move the auxiliary shifting plate 81 toward the right. Thus, the driving lever 82 makes an initial swing toward the second position against the bias of the second tension coil spring 84. At the middle of a rotational orbit of the driving lever 82, there is a dead point where no force is exerted by the first tension coil spring 83 or the second tension coil spring 84. The driving lever 82 rotates against the bias of the first tension coil spring 83 when between the first position and dead point position, and is rotated by the bias of the second tension coil spring 84 when between the dead point position and second position.

In the course of the clockwise rotation of the driving lever 82 against the first tension coil spring 83, reactive force of the first tension coil spring 83 causes the supply roller support levers 53 and 54 to move toward the upper position. When the lever grip 30 is retained with click in the second shifted position, the driving lever 82 is in the second position. Reactive force of the first tension coil spring 83 pulls the supply roller support levers 53 and 54 strongly toward the upper position. The supply roller 14 is pressed against the periphery of the recording material roll 24 at a regular pressure. The pressure of the supply roller 14 with the first tension coil spring 83 is in the direction toward the recording material roll 24, and continues even in the decrease of the diameter of the recording material roll 24 until its exhaustion.

Figure 6:
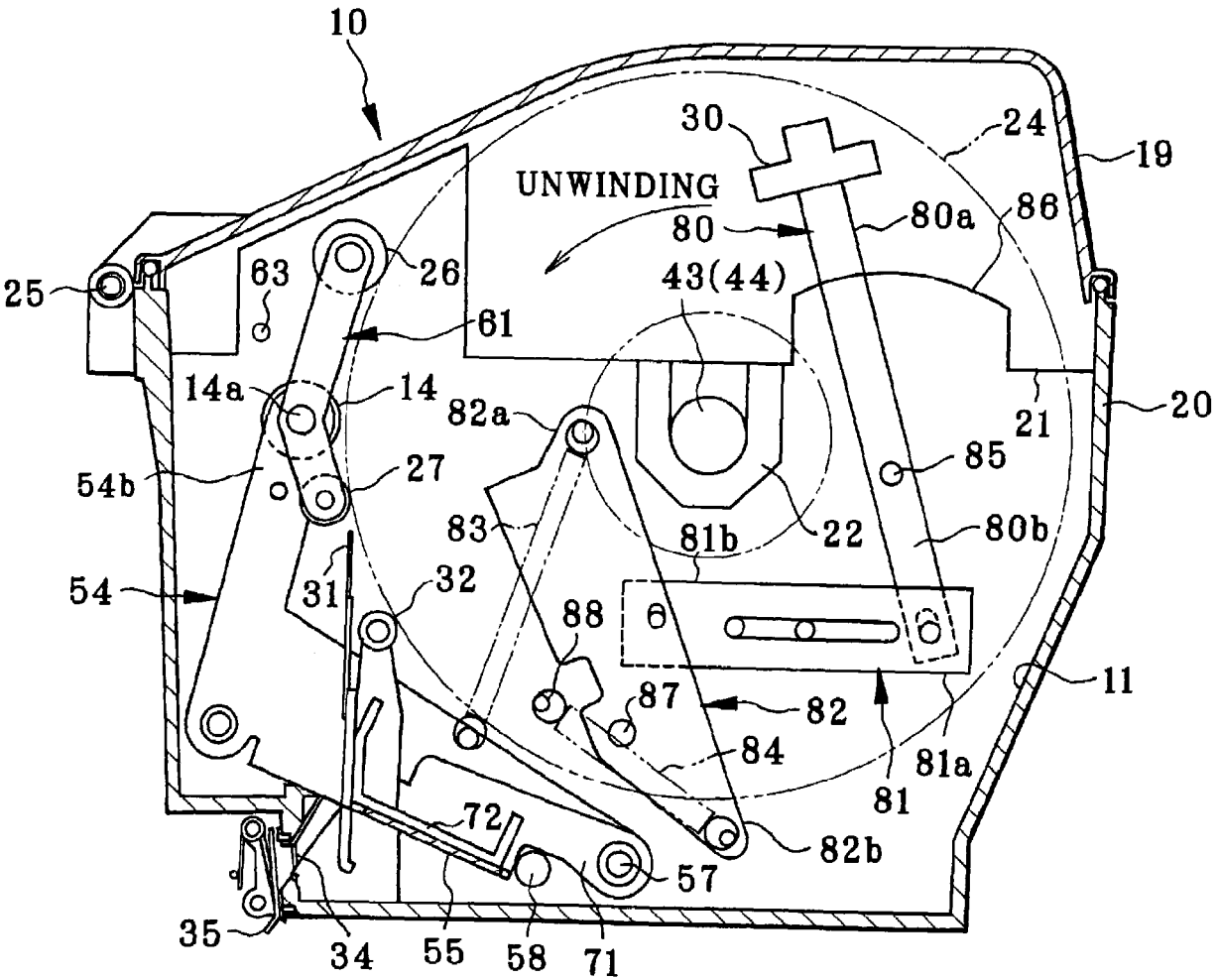
FIG. 6 is a cross section illustrating a state in the recording material magazine after shifting the pressing roller for the recording material roll.

When the supply roller 14 moves to the effective position, the main and auxiliary pressing rollers 26 and 27 are caused to contact the recording material roll 24 with pressure. See FIG. 6. Also, the rotation of the supply roller support levers 53 and 54 toward the upper position presses the plate positioning roller 32 against the periphery of the recording material roll 24. Thus, the separating plate 31 is set in the near position. The lid 19 is closed, so the loading of the recording material magazine 10 with the recording material roll unit 13 is completed.

Figure 7:
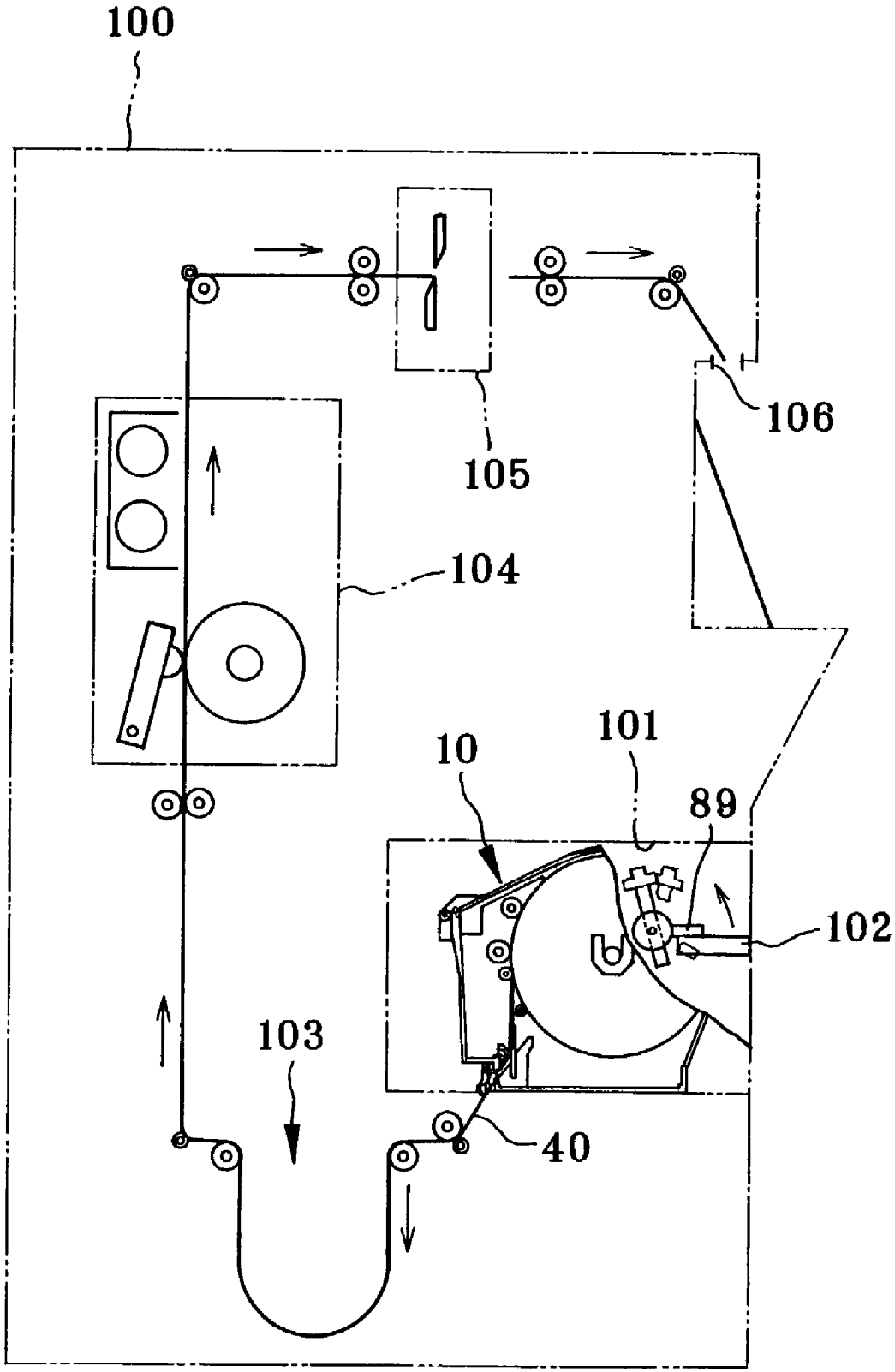
FIG. 7 is an explanatory view illustrating a thermal printer together with the recording material magazine.

The recording material magazine 10 is used to accommodate thermosensitive recording paper as the recording material 40. In FIG. 7, a color thermal printer 100 has an insertion port 101, which is loaded with the recording material magazine 10. The color thermal printer 100 is caused upon setting of the recording material magazine 10 to press the lid 19 toward the magazine casing 20 inside the body of the color thermal printer 100.

A projection 102 is formed to project from the inside of the insertion port 101. When the lever grip 30 is in the first shifted position, the projection 102 contacts the safety lever 89 of the recording material magazine 10. When the lever grip 30 is in the second shifted position, the projection 102 is away from the safety lever 89. At the time of the contact, the projection 102 rotates the safety lever 89, in order to swing the external operation lever 80 with the lever grip 30 to the second shifted position. If a user has forgotten to shift the lever grip 30 to the second shifted position in setting the recording material roll 24 in the recording material magazine 10, the projection 102 automatically shifts the lever grip 30 upon the loading in the insertion port 101. Therefore, it is possible to advance the recording material reliably.

When a command signal of starting printing is input, the color thermal printer 100 drives a lid driver to open the shutter lid 35. Then a motor in the printer rotates the supply roller 14. In the meantime, the leader of the recording material roll 24 is located in the range B between the pressing roller 26 and the supply roller 14. The pressing roller 26 presses the recording material roll 24 in a position that is offset from the leader end of the recording material roll 24 in the winding direction. When the recording material roll 24 rotates in the unwinding direction, the leader can advance in the contact position of the supply roller 14 with sufficient reliability. The leader of the recording material roll 24 in the outermost turn, when moved past the position of the supply roller 14, is picked up by the separating plate 31, guided by the end guide 16 toward the exit opening 34. The recording material 40 is sent toward the inside of the color thermal printer 100 through the exit opening 34.

The recording material 40 sent into the color thermal printer 100 is fed into a paper reservoir 103 by the feeding rollers. An image forming unit 104 of a type for three-color frame-sequential recording is supplied with the recording material 40. The image forming unit 104 moves the recording material 40 in the unwinding direction and winding direction, and prints an image to, and fixes the image on, the recording material 40 for the three colors of yellow, magenta and cyan.

There is a cutter 105, to which the recording material 40 is fed after thermal recording. When a cutting position of the recording material 40 is exactly set in the line of operating the cutter 105, the cutter 105 is actuated. A print sheet with an image frame is obtained from the recording material 40. Then the sheet is ejected through an exit 106 toward the outside of the color thermal printer 100. If a user wishes consecutive printing of two or more print sheets, the leader immediately after being cut is moved back to the image forming unit 104 by winding back. Then a second image frame is recorded to the recording material 40 in a similar manner. When the printing operation is complete, the feeding rollers are rotated back. Also, the recording material roll 24 is rotated in the winding direction by driving the gear 45, to rewind the leader of the recording material 40 to the inside of the recording material magazine 10. Note that an amount of the rewinding is predetermined such that the leader of the recording material 40 does not move back past the supply roller 14.

The renewal of the recording material roll 24 is described now. The recording material 40 does not exist in the recording material magazine 10 removed from the insertion port 101. The bias or tension of the first tension coil spring 83 sets the supply roller 14, the main and auxiliary pressing rollers 26 and 27 and the plate positioning roller 32 in much nearer positions to the axis of the recording material roll 24 than the position of contacting the recording material roll 24 with a maximum diameter. Then the lever grip 30 is shifted to the first shifted position. The driving lever 82 comes to the first position. The first tension coil spring 83 comes to apply no tensile load to the supply roller support lever 54, because of its initial length before being extended. Therefore, the supply roller support levers 53 and 54 rotate about the pivotal rod 57 in the counterclockwise direction, come to contact the stoppers 58, and are retained in the lower position. It is now easy to remove the recording material roll unit 13 being used up, as shown in FIG. 4.

In the above embodiment, the supply roller 14 or the main or auxiliary pressing roller 26 or 27, or the plate positioning roller 32 is shifted in response to shifting of the lever grip 30. However, the supply roller 14, the main and auxiliary pressing rollers 26 and 27, and the plate positioning roller 32 may be shifted in response to movement of the lid 19 for opening and closing. Also, it is possible to keep the lever grip 30 in the second shifted position by contact with the lid 19 according to the closing operation of the same.

Instead of using the main and auxiliary pressing rollers 26 and 27, any suitable type of a pressing mechanism may be used to press the outermost turn of the recording material roll 24, for example, a plate spring, a roll-shaped member made of line-shaped material, or the like. In the above embodiment, the main and auxiliary pressing rollers 26 and 27 are so disposed that the supply roller 14 is located between those. However, only one pressing roller may be used with the supply roller 14, in a manner of either one of the main and auxiliary pressing rollers 26 and 27. Specifically, it is preferable to utilize the pressing roller 26 and omit the auxiliary pressing roller 27 that is nearer to the separating plate 31. This is because a range for positioning the leader of the recording material roll 24 can be predetermined in a large size without being limited by the separating plate 31. Furthermore, at least one extra pressing roller may be provided in addition to the main and auxiliary pressing rollers 26 and 27.

In the above embodiment, the containing device is the recording material magazine 10. However, a recording material containing device may be a printer itself with a containing chamber which is loadable with the recording material roll unit 13 directly without using the recording material magazine 10. Also, the recording material magazine 10 may be a cartridge, cassette or other containers for containing the recording material roll.

In the above embodiment, the supply roller 14 is pressed against the recording material roll 24. Alternatively, the recording material roll 24 may be pressed against the supply roller 14. The supply roller 14 may be rotatable but not shiftable. The recording material roll 24 may be rotatable and also shiftable toward the supply roller 14 by means of a suitable shifting mechanism. Such a shifting mechanism can include two guide plates, two grooves and a pressing structure. The grooves are formed in the guide plates, and receive insertion of the shaft of the recording material roll unit. The pressing structure presses the shaft toward the supply roller 14. For use with this construction, the main and auxiliary pressing rollers 26 and 27 should be movable away without blocking the recording material roll 24 which is set in the recording material magazine 10.

In the above embodiment, the printer for use with the recording material magazine 10 is a color thermal printer. Furthermore, a printer may be a photographic printer. For use with this, the recording material magazine 10 can contain photographic paper of a silver halide type. Also, the recording material 40 may be an ordinary PPC type of paper that does not require shielding from light or moisture. Also in such a use, the recording material roll 24 can be set in the printer very easily even by unskilled manual operation, and the recording material 40 can be advanced reliably.

In the above embodiment, the support arms 60 and 61 have the V-shape. However, those may be formed in a curved or other suitable shape.

In the above embodiment, the first tension coil spring 83 exerts force of bias between the supply roller support lever 54 and the driving lever 82. Instead of this, other elastic elements for bias may be used, for example a gas spring, rubber band or the like. Note that the auxiliary shifting plate 81 in the above embodiment may be omitted. The external operation lever 80 may be connected with the driving lever 82 by a suitable mechanism, which can include engaging portions formed with the external operation lever 80 and the driving lever 82 in place of the feature of the auxiliary shifting plate 81.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A recording material containing device for a recording material roll constituted by winding of recording material, comprising:

a containing chamber for containing said recording material roll;

a supply roller, secured to said containing chamber in a rotatable manner, for rotating said recording material roll by contacting an outermost turn of said recording material roll, to advance said recording material to an outside of said containing chamber upon separation from said recording material roll; and a pressing mechanism, including a pressing roller disposed away from said supply roller in a winding or unwinding direction of said recording material roll, said pressing roller being caused in said pressing mechanism to press said outermost turn of said recording material roll;

an actuating mechanism, associated with said pressing mechanism, for setting said pressing roller in a releasing position before loading of said recording material roll, to form a space in said containing chamber greater than a maximum diameter of said recording material roll, so as to facilitate said loading, and for setting said pressing roller in a pressing position after said loading, to press said outermost turn of said recording material roll;

a pair of bearing mechanisms, each of which has a U-shaped gap for supporting a shaft protruding from ends of said recording material roll in a removable and rotatable manner, said shaft being included in a roll holder fitted on said recording material roll;

a pair of supply roller support levers for supporting said supply roller in a rotatable manner therebetween, each of said supply roller support levers including first and second ends, said first end constituting a center about which said supply roller support levers are rotatable, said second end supporting said supply roller;

a pair of pressing roller support arms, secured to respectively said supply roller support levers in a rotatable manner, each of said support arms including third and fourth ends, said third end supporting said pressing roller in a rotatable manner between said support arms;

an auxiliary pressing roller, secured to said fourth end in a rotatable manner between said support arms, positioned downstream from said supply roller with reference to said roll inserting direction, for contacting said outermost turn of said recording material roll; and a spring for biasing said supply roller support levers rotationally in a first direction, to set said pressing roller in said pressing position, and to set said supply roller in contact with said outermost turn of said recording material roll.

2. A recording material containing device as defined in claim 1, wherein said supply roller contacts said recording material roll in a vicinity of a portion of which a height of said outermost turn is maximum as viewed in said roll inserting direction.

3. A recording material containing device as defined in claim 2, wherein said actuating mechanism includes:

an operation lever shiftable between first and second shifted positions;

a driving lever for moving between first and second positions in response to a shift of said operation lever, said first position being away from at least a first support lever included in said supply roller support levers, said second position being close to said first support lever, said spring being connected between said driving lever and said first support lever, wherein said driving lever, when in said first position, charges said spring in a manner for rotating said first support lever in said first direction, and when in said second position, releases said spring from being charged, and allows said first lever to rotate in reverse to said first direction, so as to set said pressing roller in said releasing position, and to set said supply roller away from said outermost turn of said recording material roll.

4. A recording material containing device as defined in claim 3, further comprising:

a separator support lever, disposed coaxially with said supply roller support layers about said first end, for rotating together with said supply roller support levers; and a separating plate, secured fixedly to a free end of said separator support lever, for contacting said outermost turn of said recording material roll in a position downstream from said auxiliary pressing roller with reference to said roll inserting direction, so as to separate a leader of said recording material from said recording material roll.

5. A recording material containing device as defined in claim 4, further comprising a plate positioning roller, secured to said separator support lever and near to said free end in a rotatable manner, for contacting said outermost turn of said recording material roll a pressing mechanism, including a pressing roller, said pressing roller being freely rotatable when not in contact with said recording material roll, disposed away from said supply roller in a winding or unwinding direction of said recording material roll, said pressing roller being caused in said pressing mechanism to press said outermost turn of said recording material roll.

6. A recording material containing device as defined in claim 5, wherein said containing chamber is defined inside a magazine including a magazine casing and a lid;

said magazine casing has an upper opening, and an exit opening for passing said recording material separated by said separating plate;

said lid is secured to said magazine casing in a manner to close said upper opening in an openable manner.

* * * * *